United States Patent [19]

Griswold

[11] 3,945,462

[45] Mar. 23, 1976

[54] HANGER BRACKETS

[76] Inventor: James D. Griswold, 1490 Quartz St., Golden, Colo. 80401

[22] Filed: June 18, 1975

[21] Appl. No.: 587,934

[52] U.S. Cl. ..... 182/150; 182/113; 248/226 C; 248/241; 248/324; 248/340

[51] Int. Cl.[2] ..... E04G 3/10; E04G 5/06

[58] Field of Search ..... 182/150, 82, 222, 223, 182/36, 113; 248/235, 324, 340, 58, 277, 237, 226 C, 241

[56] References Cited

UNITED STATES PATENTS

| | | | |
|---|---|---|---|
| 632,188 | 8/1899 | Knoeferl | 182/150 |
| 1,250,930 | 12/1917 | Blaha | 182/150 |
| 2,346,338 | 4/1944 | Sway | 248/237 |
| 2,524,302 | 10/1950 | Benson | 182/150 |
| 2,582,385 | 1/1952 | Knudsen | 182/150 |
| 2,717,751 | 9/1955 | Kusiv | 248/226 C |
| 2,925,240 | 2/1960 | Laviolette | 182/36 |
| 2,980,384 | 4/1961 | Leonard | 248/324 |
| 3,314,636 | 4/1967 | McHugh | 248/340 |

*Primary Examiner*—Reinaldo P. Machado
*Attorney, Agent, or Firm*—C. B. Messenger

[57] ABSTRACT

Hanger brackets for suspending working scaffold or platform floors from overhead supports. Paired legs adjustably and pivotally joined together in scissors arrangement have finger ends for engaging overhead beams or elements thereof as depending portions of the legs that extend beneath the center pivot are moved inwardly. A spreader bar having a plurality of position adjustment openings is engaged between the depending legs to lock the fingers and bracket in place. The lower leg ends also provide a plurality of adjustment openings so the spreader bar may be engaged at alternate elevations for accommodating various staging or joist type components and for facilitating the attachment of safety elements.

9 Claims, 4 Drawing Figures

HANGER BRACKETS

BACKGROUND OF THE INVENTION

When it is necessary to paint or plaster ceilings, or to install or service utilities adjacent the overhead limits of factory or commercial structures, the installation of the necessary scaffolding can involve a considerable effort. In open warehouses roll scaffolding might be used, but most buildings have installations that prevent ready access to at least some locations. If work operations are to be continued in the building, the problem becomes more complex. In order to avoid the use of roll scaffolding and the consequent disruption of operations, the present invention provides components and a system for the use thereof that will enable scaffolding or work platforms or floors to be established at elevated positions directly above the machinery and the regular work stations in the building. Hangers are provided so that a platform may be suspended over such work areas.

While it is recognized that others have previously used hanger brackets incorporating a scissors arrangement, the present invention provides bracket units that may be applied and locked in place from points of access at lower levels and without the use of ladders that extend all the way to overhead beams so that previous types of lock components can be engaged. The spreader bar lock used herein is positioned at the lower elevations of the hanger, and it can also be adjustably installed so that various platform support elements may be used singly or in lapped arrangements.

SUMMARY OF THE INVENTION

The present invention provides hanger brackets that may be engaged with overhead beams or the like to provide support for scaffolding or platform floors. The elevated work platform supported by the hangers can also be for temporary operations or for permanent storage or work operations. The fingers that grip an overhead support are disposed on the upper ends of leg elements that are joined together in scissors arrangement. When the fingers and hanger legs are engaged, a spreader bar is placed adjacent the lower extremities of the hanger bracket legs to hold the hangers locked in place. Adjustments are provided to accommodate the hangers for use in various installations, and the spreader bar lock components may be selectively engaged to maintain a level platform arrangement. The elements that provide the desirable adjustment features can also and alternately be used to facilitate the installation of any required safety components, such as toe boards and hand rails.

DESCRIPTION OF THE PREFERRED EMBODIMENT

Figure 1:
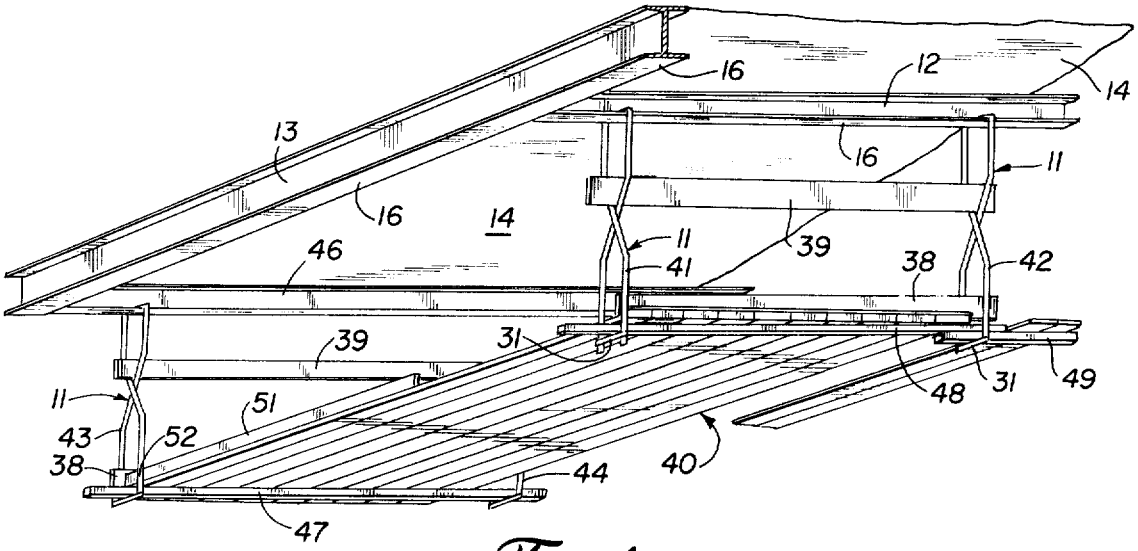
FIG. 1 is a perspective view showing the underside of a suspended platform.
Figure 2:
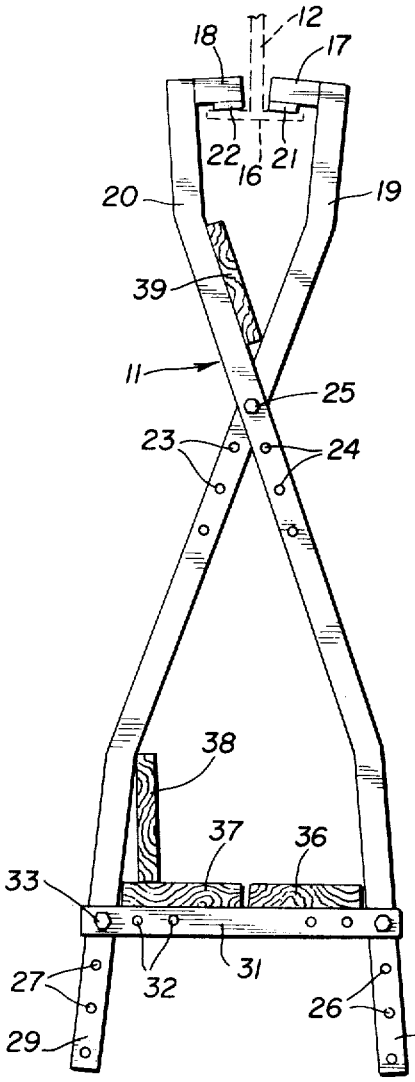
FIG. 2 is a front elevation of an embodiment of the invention.
Figure 3:
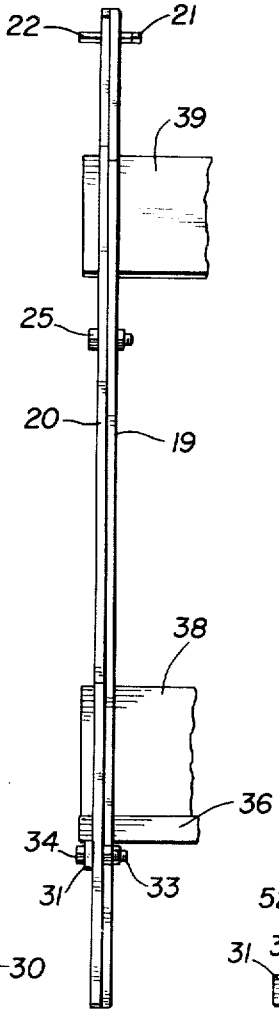
FIG. 3 is a side elevation showing further details of the FIG. 2 embodiment.
Figure 4:
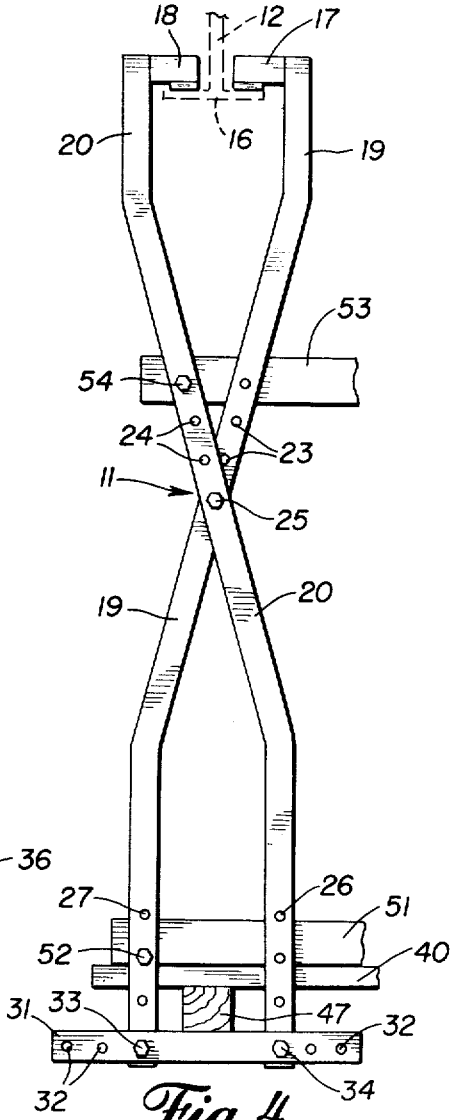
FIG. 4 is a front elevation showing the hanger bracket in alternate arrangement.

Details of a preferred embodiment of the invention are shown in FIGS. 2 through 4, while the general overall use and adaptability of such bracket embodiment is shown by the illustration of FIG. 1. In FIG. 1 sets of hanger brackets 11 are shown attached to and suspended from overhead I beams 12 and 13 of a roof or floor support system. Such I beams themselves can support a ceiling 14 that provides a closure for the work space therebeneath. When the ceiling 14 is to be plastered or painted or when lighting or other utilities disposed at the ceiling are to be installed or changed, it is often desirable to establish a working platform that is suspended at a convenient working height below the ceiling 14 and at a position above work areas of the building that are below the platform. If repairs or other installations are to be undertaken under conditions where work activities in the building are to be continued, the hanger brackets 11 disclosed herein may be attached to the bottom flange 16 of the I beams 12 and 13 or to other outwardly extending flanges of similar structural members. The type of usage illustrated could as well be supported from paired back to back channels or any other flanged or exposed type of structural element that can be gripped by the finger ends 17 and 18 of the separate hanger legs 19 and 20 that cooperatively provide a hanger bracket 11. The finger ends 17 and 18 may be joined to the leg elements 19 and 20, respectively, by welds, by fastener elements, or they may be simply bent, forged and formed of the same material as the legs to provide the return gripping ends 17 and 18.

Laterally extending contact pieces 21 and 22 are provided on the finger ends 17 and 18, respectively, to engage the bottom flange 16 or other support beam in a manner that will tend to more securely hold the depending legs 19 and 20 in a vertically hanging position. The depending legs 19 and 20 have a plurality of central adjustment openings 23 and 24 through which a center pin 25 may be extended so that the legs are held together in scissors type arrangement. Additional adjustment holes 26 and 27 are provided adjacent the lower ends of the legs 19 and 20. After the hangers 11 are engaged with an overhead beam or support, a spreader bar 31 is attached to the otherwise free leg ends to hold these lower leg ends in spaced apart positions. A plurality of holes 32 are provided in the spreader bar 31, and lock pins 33 and 34 are selectively applied through the openings 32 and mated openings 26 or 27 of the separate legs to hold the legs in correct positions. When the spreader bar is properly positioned and secured in place, the hangers 11 are locked in place and cannot be removed from the beam flanges 16 or from other positions of engagement.

For the arrangement shown in FIGS. 2 and 3 where the center pivot 25 is at a high position, the free ends 29 and 30 of the legs 19 and 20, respectively, will be relatively widely spaced apart. For this arrangement two 2×10s 36 and 37 could be placed atop separate spreader bars 31 of separate hangers 11. Accordingly, a pair of hanger brackets 11 disposed along the length of a beam could provide a working platform suspended beneath the support beams and ceiling. This type of platform would facilitate painting or servicing of the beams or the installation of utilities along the beam. For this same installation, a toe board 38 is shown. This toe board 38 is disposed in position above the lock bar 31 and against an inside surface of either leg 19 or 20. A hand rail 39 could also be disposed between adjacent brackets 11 in the position illustrated.

Usually the hanger brackets 11 will be used to provide support for timbers or joists that in turn support a larger work platform. Such type of suspended platform 40 is shown in FIG. 1. This platform is held in place by a plurality of separate hanger brackets 11. The hanger brackets 41 and 42 are engaged to and depend from the overhead I beam 12. Similar brackets 43 and 44 are suspended from an overhead beam 46. A 4×4 47 extends between the hanger brackets 43 and 44. A similar 4×4 48 extends between the hanger brackets 41 and 42. In this illustration, however, it is indicated that the platform 40 can be continued past the hanger bracket 42 to be supported by a further bracket hanging from beam 12 (not shown). The continued platform is supported by a 4×4 49 that is positioned beneath and lapped with respect to the 4×4 48.

In order to keep the sections of platform 40 level, the spreader bar 31 on the hanger 41 is disposed at a position one opening higher than the spreader bar 31 for the hanger bracket 42. If the adjustment openings 26 and 27 of the legs 19 and 20 are disposed apart a distance of approximately 3½ to 4 inches, a one opening change in positioning will provide adequate space to accommodate an additional 4×4.

The platform illustrated in FIG. 1 again is provided with toe boards 38 and hand rails 39 that are installed in the manner further indicated in FIG. 2. A further toe board 51 is disposed above the platform 40 for engagement to the hanger brackets 41 and 43 through use of bolts 52 that hold this toe board 51 in desired position. This type of installation is again shown in FIG. 4, where a hand rail 53 is shown that could be used to interconnect adjacent brackets 11, such as the hanger brackets 41 and 43 of FIG. 1. As shown in FIG. 4, the hand rail 53 is held in position on the hanger brackets by a through bolt 54. Since elevated work platforms must now provide toe or kick boards and hand rails in order to comply with the requirements of the Occupational Safety and Health Act (OSHA) or other state safety codes, it is advantageous that the adjustment openings 23, 24, 26, 27 can be additionally and beneficially used when hand rails or kick boards are to be provided.

While the brackets shown are here used for the installation of temporary staging or work platforms, it should be noted that the same brackets 11 can be used in connection with the installation of permanent support structures. The platforms thus suspended from an overhead support could be used for materials storage or even for permanent work spaces. Stairs and utilities can be provided for improved access and necessary working requirements. For either temporary or permanent installations the prime advantages of the present hanger brackets are derived from the inherent ease of installation and usage. A workman on a stepladder can carry a single bracket to an elevated position that is still considerably below the intended work level. The hanger brackets can be engaged from such lower point of access, and the spreader bar locks can also be installed. Subsequently, the joists or timbers are installed, and thereafter the platform components can be lifted into place. When all necessary work operations are accomplished from a lower level, a minimum of time and labor is required for installation of scaffolding or, in fact, for the subsequent removal thereof. This type of scaffolding can be installed directly over the regular work stations in the building or over any machinery that is supported at the floor level of the building. The potential for the continuance of regular work operations while repair activities are being undertaken enhances the use and utility of the described brackets and the platforms that can be supported thereby.

I claim:

1. Hanger brackets for the suspension of platform elements from the overhead supports of a building comprising paired components of similar construction wherein each component is inclusive of a gripping end for upward disposition to engage the building support and elongated force transmitting legs disposed angularly away from said gripping ends to depend downwardly therefrom, with each of said legs providing a plurality of longitudinally spaced apart pivot openings disposed centrally of the length thereof and with each of said legs further providing a plurality of adjustment holes disposed in longitudinally spaced positions at the second and lower ends thereof, and a pivot pin for selective disposition through separate openings in each of said leg pairs whereby the legs are joined together in scissors arrangement with the gripping ends of each leg being disposed inwardly for movement toward mutual contact, a spreader bar for extension between the otherwise free lower ends of said legs, and fasteners for selectively joining said spreader bar and the lower leg ends together when the gripping ends of said brackets are engaged to a building support.

2. Hanger brackets as set forth in claim 1 wherein said spreader bar operates additionally as a lock disposed at a lower position on said hanger brackets for ready access whereby pivotal opening movements of said legs are prevented.

3. Hanger brackets as set forth in claim 2 wherein said pivot pins are selectively disposed in said longitudinally spaced apart pivot openings to provide changed operative lengths for said spreader bar whereby platform elements of varied width are accommodated between said paired legs.

4. Hanger brackets as set forth in claim 2 wherein said spreader bar is selectively positioned at varied elevations through use of alternate adjustment holes in said legs whereby platform elements of varied height are accommodated.

5. Hanger brackets as set forth in claim 2 and further comprising contact pieces at the gripping ends of said leg components for disposition along the length of the building supports to increase the stability of said brackets.

6. Hanger brackets as set forth in claim 5 and further comprising a hand rail element disposed between adjacent hanger brackets to further increase the stability of said platform.

7. Hanger brackets as set forth in claim 6 wherein the pivot openings provided for the scissors pivot pin are additionally used for attachment of said hand rail.

8. Hanger brackets as set forth in claim 5 and further comprising a toe board disposed between adjacent hanger brackets to further increase the stability of said platform.

9. Hanger brackets as set forth in claim 8 wherein adjustment holes for said spreader bar are additionally used for attachment of said toe board.

* * * * *